US008287309B1

(12) United States Patent
Thomas et al.

(10) Patent No.: US 8,287,309 B1
(45) Date of Patent: Oct. 16, 2012

(54) HARDLINE CONNECTOR

(75) Inventors: Charles E. Thomas, Athens, PA (US); Allen L. Malloy, Elmira Heights, NY (US)

(73) Assignee: Belden Inc., St. Louis, MO (US)

( * ) Notice: Subject to any disclaimer, the term of this patent is extended or adjusted under 35 U.S.C. 154(b) by 0 days.

(21) Appl. No.: 13/175,716

(22) Filed: Jul. 1, 2011

(51) Int. Cl.
*H01R 9/05* (2006.01)

(52) U.S. Cl. ..... 439/578; 439/584

(58) Field of Classification Search ..... 439/578, 439/583, 584, 585
See application file for complete search history.

(56) References Cited

U.S. PATENT DOCUMENTS

| | | | | |
|---|---|---|---|---|
| 4,046,054 | A | 9/1977 | Gulistan | |
| 5,267,832 | A | 12/1993 | Johnson et al. | |
| 5,586,910 | A | 12/1996 | Del Negro et al. | |
| 6,331,123 | B1 | 12/2001 | Rodrigues | |
| 6,733,336 | B1 | 5/2004 | Montena et al. | |
| 6,884,115 | B2 | 4/2005 | Malloy | |
| 6,929,265 | B2 | 8/2005 | Holland et al. | |
| 7,192,308 | B2 | 3/2007 | Rodrigues et al. | |
| 7,950,961 | B2 * | 5/2011 | Chabalowski et al. | 439/584 |
| 8,033,862 | B2 * | 10/2011 | Radzik et al. | 439/578 |
| 8,075,337 | B2 * | 12/2011 | Malloy et al. | 439/578 |
| 8,113,875 | B2 * | 2/2012 | Malloy et al. | 439/578 |
| 2012/0064763 | A1 * | 3/2012 | Radzik et al. | 439/578 |

* cited by examiner

*Primary Examiner* — James Harvey
(74) *Attorney, Agent, or Firm* — Foley & Lardner LLP

(57) ABSTRACT

A coaxial cable connector includes a terminal pin secured in a nut by an insulator inserted in a half-spool retainer, a cylindrical housing connected to the half-spool retainer that receives a terminal post having a flanged first end and a cylindrical body with an axial bore, a metal ferrule, a plastic sleeve and a retaining ring. The ferrule is positioned over the body of the terminal post to form an annular space, the plastic sleeve fits over the ferrule and the retaining ring fits into the end of the plastic sleeve. The center conductor of a prepared coaxial cable is inserted into the axial bore of the terminal post and the outer conductor is positioned in the annular space. The retaining ring is pressed into the plastic sleeve to connect the center conductor to the terminal pin, collapse the ferrule to form an electrical connection between the outer conductor and the housing through the metal ferrule and secure the coaxial cable and plastic sleeve in the housing.

20 Claims, 7 Drawing Sheets

HARDLINE CONNECTOR

BACKGROUND

The present disclosure relates to electrical connectors and more particularly to axially compressible connectors for hard-line or semi-rigid coaxial cables.

Coaxial cables are high-frequency transmission lines commonly used in the cable television industry to carry high-frequency or broadband signals, such as cable TV signals to television sets. The transmission lines generally connect a broadcast or distribution facility to homes, businesses, and other locations. Typically, a hard-line (also known as "hard pipe") coaxial cable is used to carry the signals in distribution systems. Hard line coaxial cables are a heavy-duty coaxial cable with an outside shielding that can be a rigid or semi-rigid pipe, rather than flexible and braided wire. These cables are used in applications where a high degree of radio-frequency shielding is required. The hard line coaxial cables connect to terminal boxes and the signals are then distributed locally by connecting flexible coaxial cables to the terminal boxes to carry the signals throughout the interior of the locations.

The hard-line cable includes a solid wire core or inner conductor (also referred to herein as the "center conductor"), typically of copper or copper-clad aluminum, a foam-like dielectric that surrounds the core and a solid tubular outer conductor that encases the dielectric. The outer conductor is usually made of copper or aluminum. The dielectric material or insulation separates the inner and outer conductors. The outer conductor has a cable jacket or sheath that is usually made of a plastic material to insulate the cable and provide protection against corrosion and weathering.

Coaxial cables are typically connected using RF (radio frequency) connectors, which are electrical connectors designed to work at radio frequencies in the multi-megahertz range. RF connectors are designed to maintain the shielding that the coaxial design offers. Higher quality versions also minimize the change in transmission line impedance at the connection. These connectors have a fastening mechanism (thread, bayonet, braces, push pull) and springs for a low ohmic electric contact at a designed insertion force which allows multiple reconnects without reduced performance.

One type of connector used with semi-rigid coaxial cables includes threaded cable connectors. These connectors generally have moving parts at both ends of the connector and include two or three assemblies, which are rotatably connected to provide uniform compression to the coaxial cable. Typically, these connector designs require a special compression tool to complete the installation of the connector to the cable. Accordingly, there is a need for a connector for semi-rigid coaxial cables that can be quickly and easily installed on a coaxial cable without a specially designed tool.

SUMMARY

In accordance with one embodiment, a connector for connecting a coaxial cable to a device is provided. The coaxial cable has a center conductor, an outer conductor, a dielectric insulation material between the center and outer conductors and a cable jacket. The connector is formed from two sub-assemblies, a nut sub-assembly and a housing sub-assembly. The nut sub-assembly includes a nut, a terminal pin, an insulator and a half-spool retainer. The nut has a first end with an internal thread, a second end with a recessed opening and an axial bore between the first and second ends. In preferred embodiments, the first end of the nut has an internally threaded hub extending therefrom and concentric with the axial bore of the nut.

The terminal pin has a solid pin end and a connector end which has an aperture for receiving the center conductor of a coaxial cable. The aperture extends along the longitudinal axis of the connector and is defined by a cylindrically-shaped wall. In preferred embodiments, the interior of the wall has one or more circumferential groves, preferably spiral grooves, which are used to mechanically and electrically engage the center conductor of the coaxial cable. The wall of the connector end can also have one or more slots extending longitudinally, which allow the connector to be easily compressed. When the connector is closed, the wall is compressed inwardly and contacts the center conductor of the coaxial cable.

The insulator is preferably spool-shaped and has a first end, a second end, an axis between the first and second ends and an aperture extending along the axis from the first end to the second end. The solid pin end of the terminal pin is inserted through the aperture from the second end of the insulator. The half-spool retainer has a first end, a second end and a cylindrical body with an axial bore between the first and second ends. The first end of the half-spool retainer has a rim extending radially outwardly from the body and the second end has a plain cylindrical end that is flarable. When the housing is connected to the nut sub-assembly, the second end of the half-spool retainer passes through the first end of the nut and is inserted into the collar on the first end of the housing. The second end of the half-spool retainer is then flared outwardly to secure it to the housing. The insulator and the terminal pin are then passed through the first end of the housing and inserted into the half-spool retainer.

The housing sub-assembly includes a housing, a terminal post, a metal ferrule, a plastic sleeve and a retaining ring and, optionally, one or more O-rings. The housing has a cylindrical body with a first end, a second end and an axial bore between the first and second ends. The first end of the housing has a collar that connects to the second end of the half-spool retainer and the second end has a latching mechanism for securing the coaxial cable in the housing. In preferred embodiments, the housing also includes a neck which extends between the first end of the housing and the collar.

The terminal post has a cylindrical body with a blank or solid flange on the first end, a plain second end and an axial bore between the flange on the first end and the second end. As used herein, the term "blank flange" refers to a flange in the form of a substantially solid disc which extends beyond the cylindrical body but does not have an opening in the center corresponding to the axial bore of the cylindrical body to which it is attached. The body of the terminal post has an external surface with an outer diameter which is sized to receive the outer conductor of the coaxial cable. The terminal post is made from a non-electrically conductive material, such as a hard plastic or nylon.

The flange at the first end of the terminal post has an aperture with a first end on the face of the flange and a second end that is communication with the axial bore in the body. Preferably, the first end of the aperture is preferably beveled for receiving the connector end of the terminal pin and the second end of the aperture is tapered inwardly from the surface towards the middle of the flange to facilitate insertion of the center conductor of a coaxial cable. Thus, in the preferred embodiment, the diameter of the aperture at the two ends is greater than the diameter of the middle portion of the aperture. The center conductor of a coaxial cable is inserted into the second end of the terminal post and passes through the axial bore and the aperture in the flange before terminating in the connector end of the terminal pin. When the connector is closed to secure the coaxial cable, the connector end of the terminal pin is forced into the beveled end of the terminal post. This forces the wall of the connector end inwardly so that it electrically and mechanically contacts the center conductor of the coaxial cable. Preferably, the connector end of the terminal pin has slots in the walls, which facilitate the wall compressing inwardly and contacting the center conductor.

The ferrule is formed of an electrically conductive material and has a first end, a second end, an outer surface, an inner surface and a slot that extends between the first and second ends. The compression of the ferrule is facilitated by the slot. The ferrule can also be corrugated to provide a plurality of ring-like surfaces between the first and second ends, which are used to grip the outside of a coaxial cable. The first end of the ferrule slidably receives the second end of the terminal post. After the ferrule is positioned over the terminal post, the inner diameter of the ferrule can be reduced by applying a compressive force to the exterior surface.

The plastic sleeve has a first end, which slidably receives the second end of the ferrule, and a second end that has a rim extending outwardly from the surface. The plastic sleeve can also have a circumferential groove on the exterior surface next to the rim. The retaining ring has a first end, a flanged second end and an axial bore therebetween. The first end of the retaining ring is inserted into the second end of the plastic sleeve to secure the plastic sleeve in the latching mechanism at the second end of the housing. The groove on the exterior surface of the plastic sleeve engages the latching mechanism when force is applied to the second end of the retaining ring.

In one embodiment, the first end of the ferrule includes a first section that has a first inner diameter and the second end of the ferrule includes a second section that has a second inner diameter. Between the ferrule and the body of the terminal post an annular space is formed. In the first section of the ferrule, the annular space is sized to receive the outer conductor of a coaxial cable with the cable jacket and dielectric insulation material removed. In the second section, the annular space is sized to receive the outer conductor and the cable jacket of the coaxial cable with the dielectric insulation material removed.

In another embodiment, the ferrule includes a first section at the first end having a first inner diameter and a first outer diameter, a second section at the second end having a second inner diameter and a second outer diameter and a mid-section between the first and second ends which has a third inner diameter and a third outer diameter. The first and third inner diameters of the ferrule are substantially equal and less than the second inner diameter and the third outer diameter of the ferrule is greater than the first and second outer diameters. In addition, the first end of the housing can include a first section having a first interior surface and a first inner diameter and the second end of the housing can include a second section having a second interior surface and a second inner diameter which is larger than the first inner diameter. When the ferrule, plastic sleeve and retaining ring are inserted into the second end of the housing and a force is applied, the connector end of the terminal pin compresses around the center conductor, the first end of the ferrule compresses between the inner surface of the first section of the housing and the terminal post, the first end of the plastic sleeve compresses against the second end of the ferrule and the second end of the terminal post and the circumferential groove in the plastic sleeve engages the latching mechanism.

BRIEF DESCRIPTION OF THE DRAWINGS

Various embodiments of the connector for a semi-rigid coaxial cable of the present disclosure, as well as other objects, features and advantages, will be apparent from the accompanying drawings wherein.

DETAILED DESCRIPTION

Figure 1:
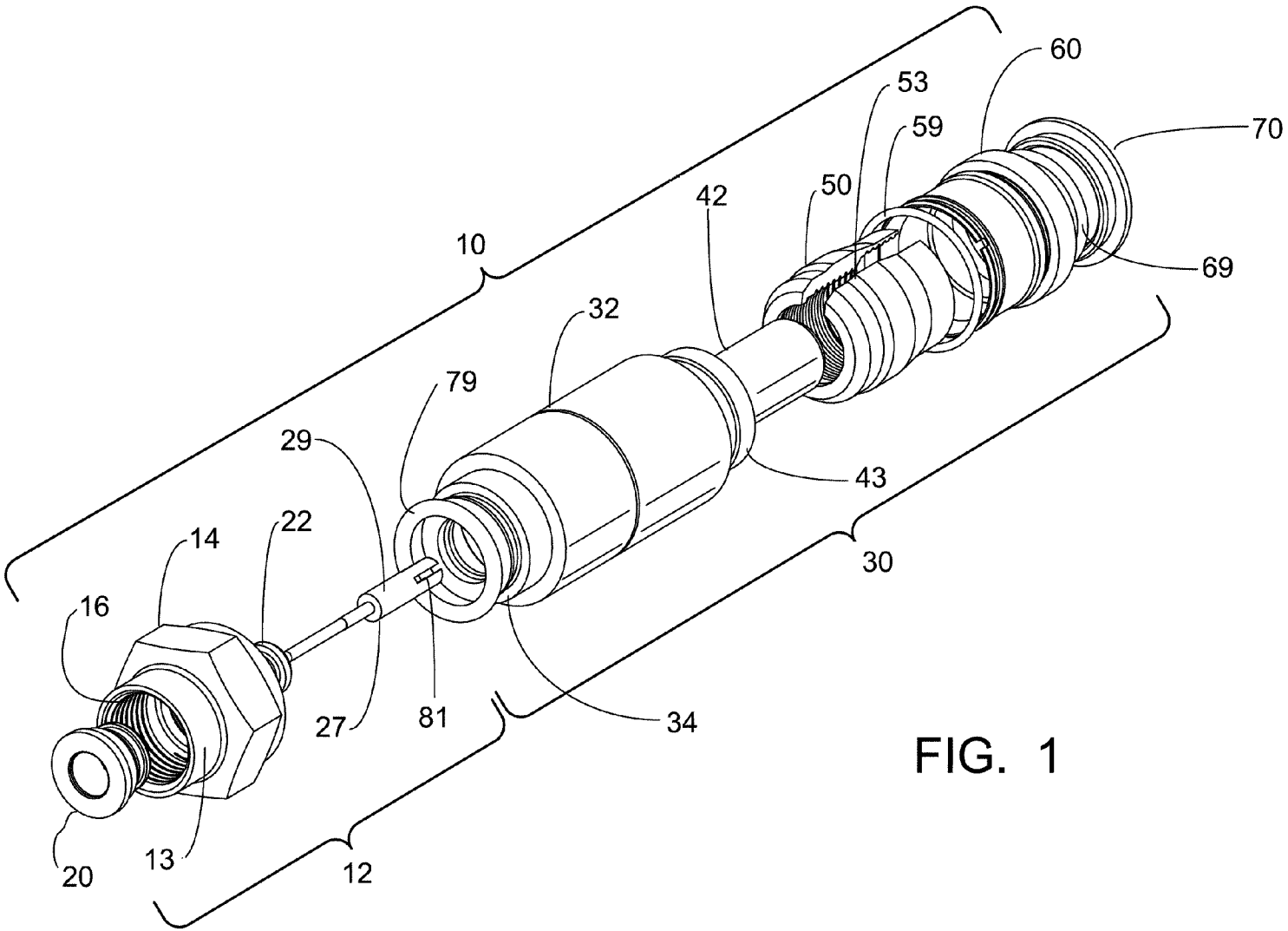
FIG. 1 is an exploded, perspective view of a connector according to an exemplary embodiment.

The present disclosure is generally directed to a connector with internal moving components that grip a coaxial cable to electrically and mechanically secure it in the connector. This connector is an improvement of the connectors described in U.S. Pat. No. 6,884,115 to Malloy and U.S. Pat. No. 6,331,123 to Rodrigues, which are incorporated herein by reference in their entirety. The connector of the present disclosure eliminates the need for a special compression tool to complete installation by limiting the moving parts to only one end of the connector. This allows any plunger type compression tool that can provide sufficient force to be used for installation.

The connector is formed by a nut sub-assembly and a housing sub-assembly. The nut sub-assembly includes a nut, a terminal pin, an insulator and a half-spool retainer. The nut has an internally threaded first end, a second end with a recessed opening and an axial bore between the first and second ends. Between the threaded first end and the recessed opening in the second end of the nut, a lip extends radially inwardly from the interior wall and reduces the inner diameter of the axial bore. In the recessed opening at the second end of the nut, the half-spool retainer connects to the collar on the first end of the housing. A similar connection is disclosed in U.S. Pat. No. 7,192,308 to Rodrigues, et al. which is incorporated herein by reference in its entirety. The terminal pin includes a solid pin end and a connector end with a cylindrically-shaped wall that defines an aperture for receiving the center conductor of a coaxial cable. The connector end can have one or more slots in the wall that extend substantially parallel to the longitudinal axis and a plurality of circumferential grooves on the surface of the interior wall. The slots and grooves allow the connector to securely engage the center conductor of the coaxial cable.

The insulator is preferably spool-shaped and has a first end, a second end and an aperture extending along the axis between the first and second ends. The shape of the insulator is selected to minimize interference with the signal transmitted through the coaxial cable. Preferably, the spool-shaped insulator is made of a non-electrically conductive material, such as a plastic or nylon, and the aperture is sized so that the solid pin end of the terminal pin fits snugly into the aperture.

The half-spool retainer has a cylindrical body, a first end with a rim extending from the outer surface of the body, a plain second end that is flarable and an axial bore between the first and second ends. As used herein, the term "flarable" means that the second end can be radially opened or spread outwardly. Typically, after the collar on the housing is fitted over the half-spool retainer, the second end of the half-spool retainer is flared by inserting a tool having a tapered end into the axial bore at the second end and applying a force. The force displaces the wall at the second end of the half-spool retainer outwardly and forms a rim extending radially outwardly. Similar flarable retainers are disclosed in U.S. Pat. No. 4,046,054 to Gulistan and U.S. Pat. No. 5,267,832 to Johnson et al., both of which are incorporated herein by reference with respect to the flarable retainer. When the threaded first end of the nut is connected to a male connector on a device, the tightening of the nut on the male connector tightly secures the half-spool retainer in the nut.

When the connector is assembled, the second end of the half-spool retainer passes through the first end of the nut until the rim on the first end engages the lip in the central portion of the nut. The second end of the half-spool retainer is inserted into the collar at the first end of the housing and flared to secure the collar to the half-spool retainer. Although the collar is secured to the half-spool retainer, it can freely rotate in the recessed opening of the nut. After the second end of the half-spool retainer is attached to the collar, the solid pin end of the terminal pin is inserted into the aperture in the spool-shaped insulator from the second end. The solid pin end and the first end of the spool-shaped insulator are then inserted through the housing into the second end of the half-spool retainer as described in more detail below.

The housing sub-assembly includes a housing, a terminal post, a ferrule, a plastic sleeve and a retaining ring. In addition, the housing sub-assembly can include one or more O-rings between these components for sealing the interior of the housing from moisture and dust. The housing has a substantially cylindrical body with a first end, a second end and an axial bore between the first and second ends. The first end of the housing has a substantially round collar with an opening that has an inner perimeter and an outer perimeter. Preferably, the housing has at least two sections. The first section at the first end of the housing has a first inner diameter and the second section at the second end of the housing has a second inner diameter which is greater than the first inner diameter.

When the nut sub-assembly and the housing sub-assembly are assembled, the outer perimeter of the collar is received by the recessed opening in the nut and the inner perimeter of the collar receives the second end of the half-spool retainer. Preferably, the outer perimeter of the collar is fitted with an O-ring to form at least a partial seal between the collar and the interior wall of the recessed opening. The housing can also include a neck that connects the collar to the first end of the housing. The second end of the housing has a latching mechanism, which is used to secure a coaxial cable in the housing. The latching mechanism can be continuous or discontinuous raised surface extending radially inwardly from the interior surface of the housing and engages the plastic sleeve.

The terminal post is preferably made from a non-electrically conductive material, preferably plastic or nylon, and includes a cylindrical body that has a flange on the first end, a plain second end and an axial bore between the flange and second end. The flange is substantially solid on the first end of the body except for an aperture in the center. The outside surface of the flange (i.e., the side opposite the cylindrical body) is beveled around the aperture for receiving the connector end of the pin terminal. The aperture on the inside surface of the flange is tapered in a funnel-like manner from the surface inwards to facilitate the insertion of the center conductor of a coaxial cable into the aperture. The center conductor of the coaxial cable is inserted through the second end of the terminal post and passes through the aperture in the flange and into the connector end of the terminal pin.

The ferrule is formed of an electrically conductive material, preferably brass or copper, and has a first end, a second end, an outer surface, an inner surface and a slot extending between the first and second ends. The first end of the ferrule fits over and slidably receives the second end of the terminal post so that an annular space is formed between the exterior of the cylindrical terminal post body and the interior surface of the ferrule. The slot in the ferrule allows the inner diameter of the ferrule to be decreased by the application of compressive radial force on the exterior surface. When the outer conductor of a coaxial cable is placed between the body of the terminal post and the ferrule, the ferrule can be compressed to electrically contact the outer conductor. The ferrule can have a corrugated construction, which provides ring-like surfaces on both the interior and exterior surfaces for gripping the outer conductor and/or jacket of the coaxial cable and the plastic sleeve.

The plastic sleeve of the housing assembly has a substantially cylindrical body, a first end that fits over and slidably receives the second end of the ferrule and a rim extending radially from the outer surface at the second end. The exterior surface of the plastic sleeve also has a circumferential groove on the inner side of the rim. The retaining ring has a plain first end, a flanged second end and an axial bore extending between the two ends. The first end of the retaining ring is inserted into the second end of the plastic sleeve so that the bottom surface of the flange contacts the inside surface at the second end of the plastic sleeve. Pushing the retaining ring into the second end of the plastic sleeve causes the groove in the plastic sleeve to engage the latching mechanism on the second end of the housing. This secures the retaining ring, plastic sleeve, ferrule and terminal post, as well as the coaxial cable, in the housing.

The connector is assembled by first inserting the second end of the half-spool retainer into the first end of the nut. The rim on the first end of the half-spool retainer engages the lip inside the nut and prevents the retainer from passing entirely through the axial bore of the nut. The second end of the half-spool retainer extends past the lip and into the recessed opening in the second end of the nut. An O-ring is then placed over the collar at the first end of the housing and, with the half-spool retainer held in the nut, the collar is fitted over the second end of the half-spool retainer. The half-spool retainer is then secured to the collar by inserting a flaring tool through the second end of the housing and flaring the second end of the half-spool retainer outwardly.

After the collar is secured to the half-spool retainer, the solid pin end of the terminal pin is inserted into the second end of the spool-shaped insulator to form a terminal pin/insulator sub-assembly, which is then inserted "pin end" first through the second end of the housing and into the half-spool retainer. In addition to extending radially outwardly from the body on the first end, the rim of the half-spool retainer also extends inwardly so that the inner diameter of the first end is less than the inner diameter of the second end. When the spool-shaped insulator is inserted into the half-spool retainer, the rim prevents it from passing through the first end of the half-spool retainer. In addition, the outer edges of the rims on the ends of the spool-shaped insulator fit snugly against the inner wall of the half-spool retainer and secure the terminal pin/insulator assembly in the half-spool retainer.

Prior to assembling the housing sub-assembly, an O-ring is fitted over the first end of the plastic sleeve and moved towards the second end and positioned next to the rim. A second O-ring is fitted into the second end of the plastic sleeve followed by the retaining ring, which holds the O-ring in place. The housing sub-assembly is then assembled by inserting, in order, the terminal post, ferrule, and plastic sleeve into the second end of the housing with successive components telescopically sliding over the preceding component. The terminal post and ferrule pass entirely inside the housing but only the first end of the plastic sleeve is inserted into the housing. This configuration is referred to herein as the "open position" of the connector.

Before the connector is installed on a coaxial cable, the end of the coaxial cable is prepared by stripping the outer cover of the cable and removing the dielectric insulating material and a portion of the outer conductor. Preferably, the prepared end of the coaxial cable has about 0.20-0.75 inches, most preferably about 0.38 inches, of the outer conductor exposed and the exposed center conductor extends about 0.25-0.75 inches, most preferably about 0.44 inches, beyond the outer conductor. In addition, about 0.30-0.80 inches, most preferably about 0.56 inches, of the dielectric insulation material is removed from under the outer conductor to expose the center conductor. With the connector in the open position, the coaxial cable is inserted into the retaining ring/plastic sleeve at the second end of the housing. The center conductor passes through the axial bore of the terminal post and the aperture in the flanged end and is inserted into the connector end of the terminal pin. The outer conductor passes over the exterior surface of the cylindrical body of the terminal post, between the terminal post and the ferrule and next to the flange at the first end of the terminal post. The outer conductor is exposed from approximately the mid-point of the terminal post to the flange on the first end.

After the coaxial cable is positioned in the connector, the retaining ring and plastic sleeve are pushed into the housing. Typically, a plunger type compression tool is used to force the retaining ring/plastic sleeve into the housing. This force also moves the terminal post further into the housing towards the first end and moves the center conductor further into the connector end of the terminal pin. At the same time, the connector end of the terminal pin contacts the beveled aperture in the terminal post flange, which compresses the wall of the connector end around the center conductor. When the outer edge of terminal post flange contacts the inner surface of the first section of the housing, it cannot move any further into the housing. Thereafter, applying force to the retaining ring pushes the plastic sleeve over the second end of the metal ferrule. In addition, as the ferrule moves further into the housing the decreased inner diameter of the housing compresses the first end of the ferrule inwardly so that it electrically contacts the outer conductor of the coaxial cable. As the plastic sleeve moves further into the housing, the first end of the plastic sleeve compresses the second end of the ferrule around the insulated portion of the coaxial cable to mechanically secure the cable in the connector. The assembly of the connector is completed when the retaining ring is pressed into the second end of the plastic sleeve and the circumferential groove on the plastic sleeve engages the latching mechanism at the second end of the housing to secure the plastic sleeve in the housing. This configuration is referred to herein as the "closed position" of the connector. In the closed position, the terminal pin closure on the center conductor is actuated and the ferrule forms an electrical connection between the outer conductor of the coaxial cable and the housing.

As the connector moves from the open position to the closed position, the components inside the housing slide or pass one over another like the cylindrical sections of a collapsible hand telescope. In sequential order, the terminal post, the ferrule and the plastic sleeve collapse over the preceding component, followed by the retaining ring that fits inside the second end of the plastic sleeve, to electrically and mechanically connect the coaxial cable. In addition, one or more O-rings can be positioned between the components inside the housing to provide a seal between the components or between the components and the housing. The housing, the terminal pin and the ferrule are made from an electrically conductive metal, preferably copper or brass. The plastic sleeve is preferably made from a hard plastic, but it can also be made from nylon. The retaining ring is preferably made from metal but can also be made from a hard plastic or nylon. The nut and the half-spool retainer are made from an electrically conductive metal, preferably copper or brass, while the spool-shaped insulator is made from an electrically non-conductive material, such as a plastic or nylon. The O-rings can be made from a rubber, a soft plastic or a nylon material.

Figure 2:
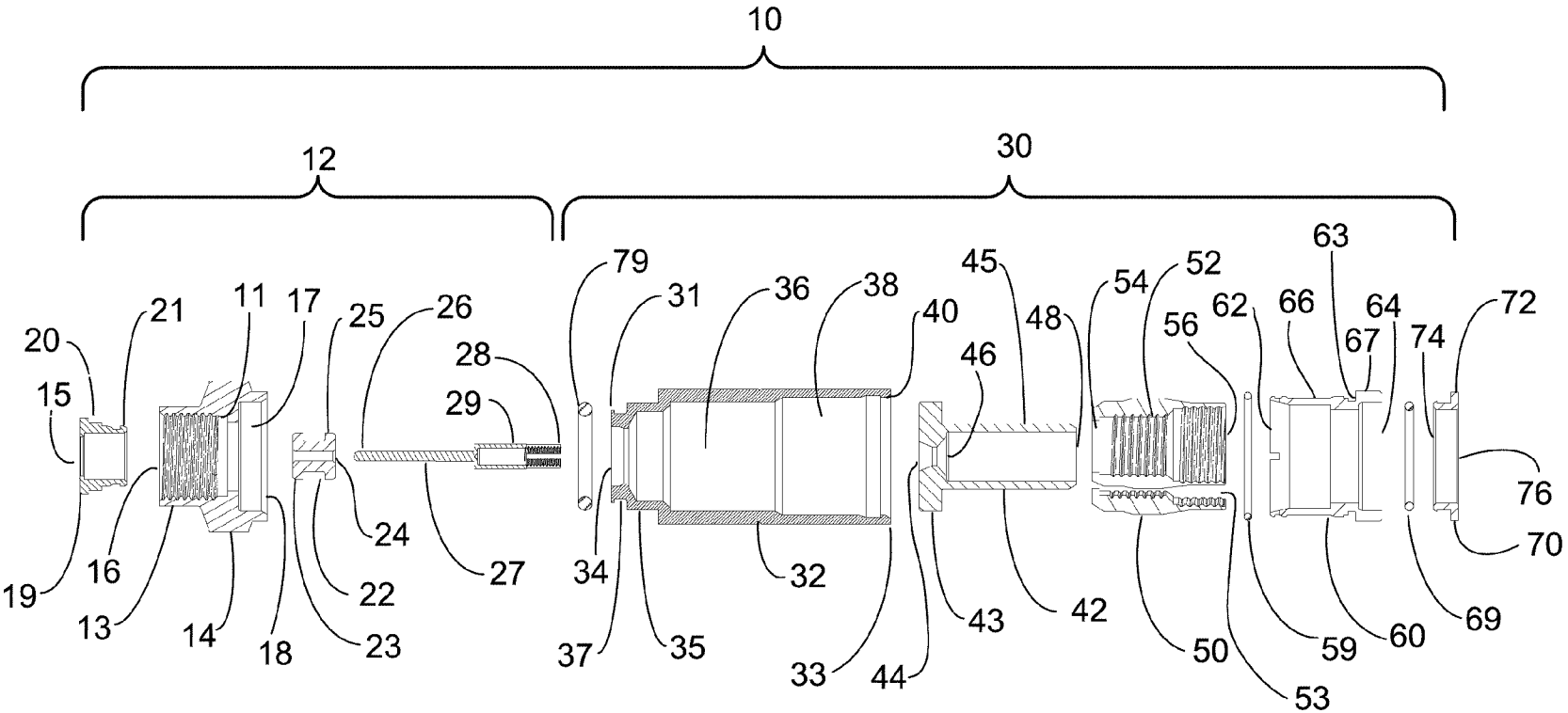
FIG. 2 is an exploded, side view of a connector according to an exemplary embodiment.

Referring now to the drawings, FIGS. 1 and 2 show exploded views of one embodiment of the connector 10, which is formed by a nut sub-assembly 12 and a housing sub-assembly 30. The nut sub-assembly 12 includes a nut 14, a half-spool retainer 20, a spool-shaped insulator 22 and a terminal pin 27. The nut 14 has a threaded hub 13 attached to the first end 16 for connection to a termination device (not shown) and a recessed opening 17 (see FIG. 2) at the second end 18 for receiving the collar 34 of the housing assembly 30. The nut 14 also has a lip 11 near the center, which extends inwardly from the axial bore and reduces the inner diameter of the axial bore. The half-spool retainer 20 is cylindrically shaped and has a rim 19 on the first end, a plain second end 21 and an axial bore 15 between the two ends. When the half-spool retainer 20 is inserted into the nut 14, the rim 21 on the half-spool retainer 20 contacts the lip 11, which prevents further passage of the half-spool retainer 20 through the axial bore of the nut 14.

The spool-shaped insulator 22 has a first end 23, a second end 25 and an aperture 24 along the axis between the two ends 23, 25. The nut sub-assembly 12 also includes a terminal pin 27, which is secured in the nut 14 by the spool-shaped insulator 22 and the half-spool retainer 20. The terminal pin 27 has a solid pin end 26 for connecting to an electrical device (not shown) and a connector end 28 (see FIG. 2) for receiving the center conductor 96 of a coaxial cable 90 (see FIG. 6). The connector end 28 has a cylindrically-shaped wall 29 and can have one or more slots 81 and/or a plurality of circumferential grooves 83 (see FIG. 4) on the interior surface of the wall 29, which facilitate compressing the connector end 28 and engaging the center conductor 96 of a coaxial cable 90. The solid pin end 26 is inserted into the aperture 24 in the insulator 22 and is snugly secured in the insulator 22. The solid pin end 26 and insulator 22 are secured in the nut 14 by the half-spool retainer 20, which is inserted into the nut 14 from the first end 16. The solid pin end 26 of the terminal pin 27 passes through the half-spool retainer 20 and extends beyond the threaded end 16 of the nut 14.

The housing sub-assembly 30 includes a housing 32 that has a collar 34 on the first end 31 and a latching mechanism 40 on the second end 33. FIG. 2 shows the housing 32 receiving, in sequential order, a terminal post 42, a ferrule 50, an O-ring 59, a plastic sleeve 60, a second O-ring 69 and a retaining ring 70. The housing 32 is substantially cylindrical in shape and has a first section 36, a second section 38 and an axial bore that extends between the first end 31 and the second end 33. A neck 35 connects the collar 34 to the first section 36 of the housing 32 and the collar 34 has a notch 37 between the neck 35 and the first end 31 of the housing 32. An O-ring 79 is fitted over the outer perimeter of the collar 34 into the notch 37 before the second end 21 of the half-spool retainer 20 is inserted into the collar 34. The O-ring 79 forms a seal with the wall of the recessed opening 17 at the second end 18 of the nut 14.

The second end 33 of the housing 32 receives a coaxial cable 90 (see FIG. 6) having a center conductor 96 and an outer conductor 92. The connection between the terminal pin 27 and the center conductor 96 of the coaxial cable 90 is made in the first section 36 of the housing 32 and the coaxial cable 90 is secured in the second section 38 of the housing 32 (see FIG. 6). When the nut sub-assembly 12 and the housing sub-assembly 30 are assembled, the second end 21 of the half-spool retainer 20 passes through the first end 16 of the nut 14 and is inserted into the collar 34 at the first end 31 of the housing 32. A flaring tool is then inserted into the second end 33 of the housing 32 and is used to form a flared second end 21*a* of the half-spool retainer 20 outwardly, which secures the half-spool retainer 20 in the collar 34. The O-ring 79 on the outside of the collar 34 forms a seal between the collar 34 and the nut 14. The solid pin end 26 of the terminal pin 27 (secured in the spool-shaped insulator 22) is then passed through the second end 33 of the housing 32 and inserted in the half-spool retainer 20. The ends 23, 25 of the spool-shaped insulator 22 snugly contacts the interior wall of the axial bore 15 of the half-spool retainer 20 and secure the spool-shaped insulator 22 and the terminal pin 27 in the half-spool retainer 20.

The terminal post 42 has a cylindrically shaped body 45, a blank flange 43 on the first end 44 with an aperture 46, a plain second end 48 and an axial bore between the flange 43 at the first end 44 and the second end 48. The flange 43 has an aperture 46 that is smaller than the opening in the plain end 48 and this aperture 46 is sized to accommodate the center conductor 96 of the coaxial cable 90 (see FIG. 6). The outside diameter of the flange 43 is sized so that it can pass through the second section 38 of the housing 32 and fit snugly against the interior wall of the first section 36 (see FIG. 3). A flexible metal ferrule 50 having a first end 54, a second end 56 and a slot 53 between the two ends 54, 56 is sized to fit over the body 45 of the terminal post 42 and into the second end 33 of the housing 32. The ferrule 50 can have a plurality of ridges 52 on the interior surface for gripping the coaxial cable 90 (see FIG. 6).

A plastic sleeve 60 having a first end 62, a second end 64, a flexible body 66 extending between the ends 62, 64 and a circumferential groove 63 next to a rim 67 on the second end 64 fits over the second end 56 of the ferrule 50. Before the plastic sleeve 60 is positioned over the ferrule 50, an O-ring 59 can be fitted over the first end 62 of the plastic sleeve 60 and positioned next to the rim 67. The first end 62 of the plastic sleeve 60 fits over the second end 56 of the ferrule 50 and, when the connector 10 is in the closed position, the plastic sleeve 60 compresses the ferrule 50 against the terminal post 42 to secure the coaxial cable 90 (see FIG. 6) in the housing 32. A second O-ring 69 can then be inserted into the second end 64 of the plastic sleeve 60 and secured in place by the retaining ring 70. The retaining ring 70 has a plain first end 74 and a flange 72 on the second end 76. As the plastic sleeve 60 passes into the housing 32, the groove 63 on the outer surface of the plastic sleeve 60 engages the latching mechanism 40 on the second end 33 of the hosing 32. Pushing the retaining ring 70 into the second end 64 of the plastic sleeve 60 secures the plastic sleeve 60 in the latching mechanism 40.

Figure 3:
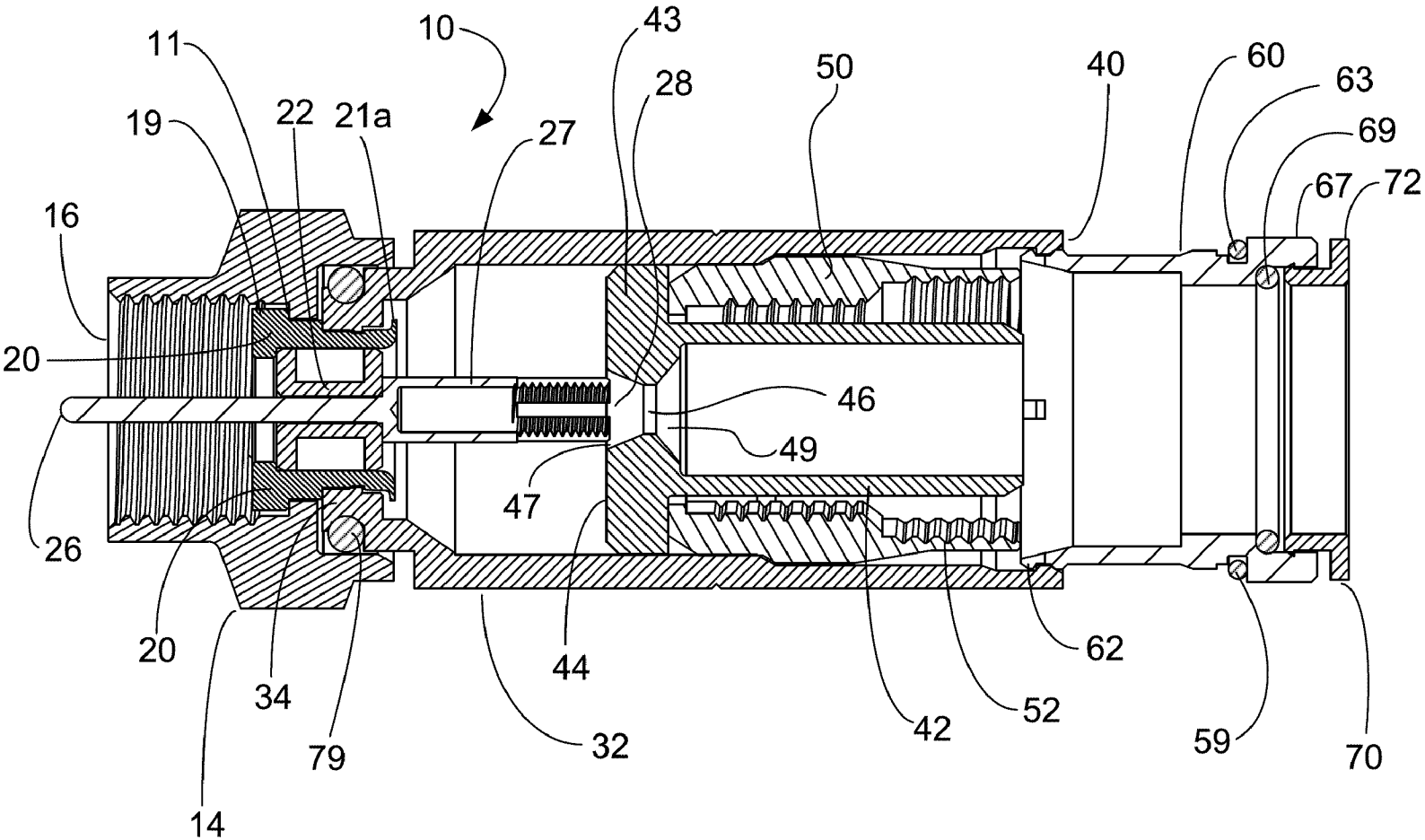
FIG. 3 is a sectional, side view of a connector in the open position according to an exemplary embodiment.

FIG. 3 shows a sectional view of the connector 10 with the housing 32 connected to the nut 14 and the connector end 28 of the terminal pin 27 aligned with the aperture 46 in the flange 43 at the first end 44 of the terminal post 42. The ferrule 50 is fitted over the terminal post 42 and inserted into the housing 32 and the first end 62 of the plastic sleeve 60 is positioned just inside the housing 32 next to the second end 48 of the terminal post 42. A first O-ring 59 is positioned on the plastic sleeve 60 next to the rim 67 at the second end 64 and a second O-ring 69 is inserted into the second end 64 of the plastic sleeve 60 followed by the retaining ring 70.

FIG. 3 also shows the collar 34 on the first end 31 of the housing 32 secured in the nut 14. The flared second end 21*a* of the half-spool retainer 20 holds the collar 34 in the nut 14 and the O-ring 79 on the outer perimeter of the collar 34 provides a snug fit between the collar 34 and the recessed opening 17 in the nut 14. However, the seal does not prevent the housing 32 from being rotated in relation to the nut 14.

Figure 4:
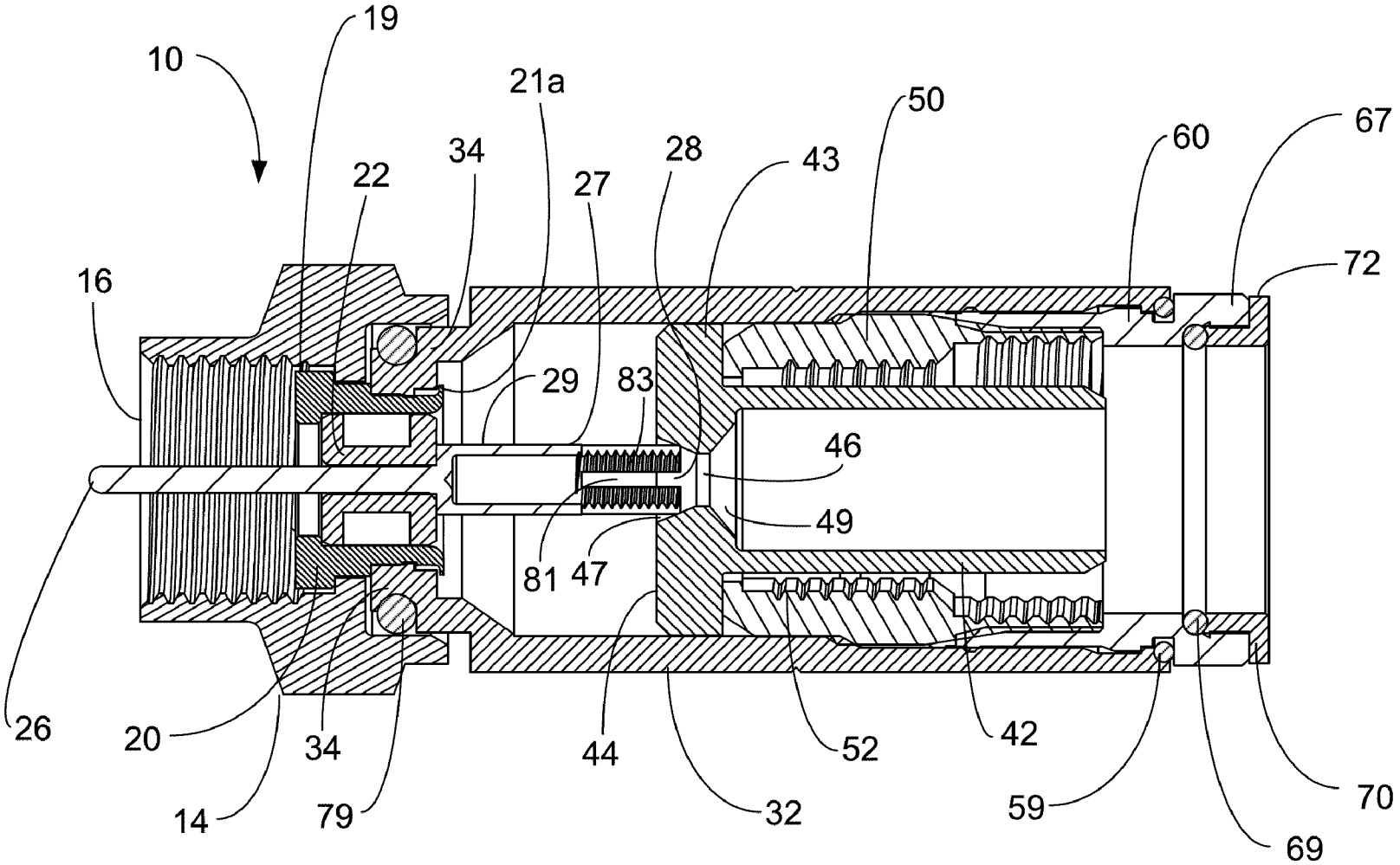
FIG. 4 is a sectional, side view of a connector in the closed position according to an exemplary embodiment.

FIG. 4 shows the connector 10 after the plastic sleeve 60 is secured in the latching mechanism 40 and the retaining ring 70 is secured in the second end 64 of the plastic sleeve 60. When the first end 62 of the sleeve 60 is pushed into the housing 32, it compresses the second end 56 of the ferrule 50 inwardly towards the body 45 of the terminal post 42. At the same time, the beveled portion 47 around the aperture 46 of the flange 43 on the first end 44 of the terminal post 42 receives the connector end 28 of the terminal pin 27. As the connector end 28 is forced into the beveled portion 47, the connector end 28 is compressed inwardly around the center conductor 96 (see FIG. 6). The slots 81 in the connector end 28 of the terminal pin 27 allow the wall 29 to be easily compressed and the circumferential grooves 83 on the interior of the wall 29 grip the center conductor 96. On the inside of the flange 43, the aperture 46 has a tapered side wall 49 which facilitates the insertion of the center conductor 96 of the coaxial cable 90 (see FIG. 6) into the aperture 46.

Figure 5:
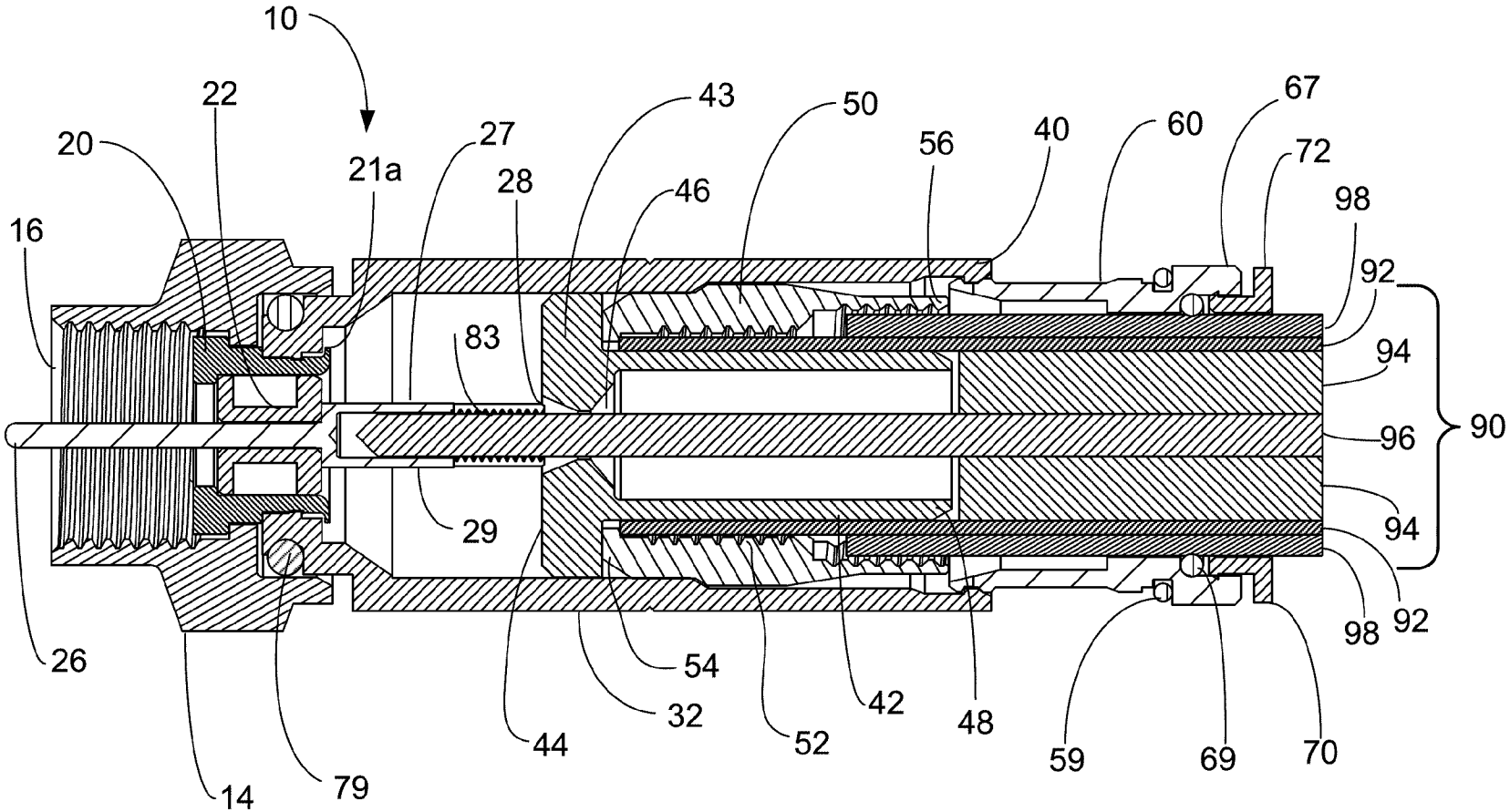
FIG. 5 is a sectional, side view of a connector in the open position with a coaxial cable inserted in the connector according to an exemplary embodiment.

FIG. 5 shows the connector 10 in the open position with a coaxial cable 90 inserted through the second end 33 of the housing 32. The coaxial cable 90 includes, in order from the center outwards, a center conductor 96, a dielectric insulation material 94, an outer conductor 92 and a jacket 98. The jacket 98 near the end of the coaxial cable 90 is removed to expose the outer conductor 92 and a portion of the outer conductor 92 is removed so that the center conductor 96 is exposed at the end of the coaxial cable 90. The dielectric insulation material 94 is also removed from the end of the coaxial cable 90 to a point under the jacket 98 so that the body 45 of the terminal post 42 can be inserted between the outer conductor 92 and the center conductor 96. The outer conductor 92 is covered by the jacket 98 of the coaxial cable 90 over about one third of the body 45 beginning at the second end 48 of the terminal post 42. The terminal post 42 and the ferrule 50 are inserted into the housing 32 and the center conductor 96 of the coaxial cable 90 is inserted through the aperture 46 in the flange 43 and into the connector end 28 of the terminal pin 27. FIG. 5 shows the connector 10 in the open position with only the first end 62 of the plastic sleeve 60 inserted into the housing 32. In this position, the plastic sleeve 60 asserts only minimal compressive force against the ferrule 50 and coaxial cable 90.

Figure 6:
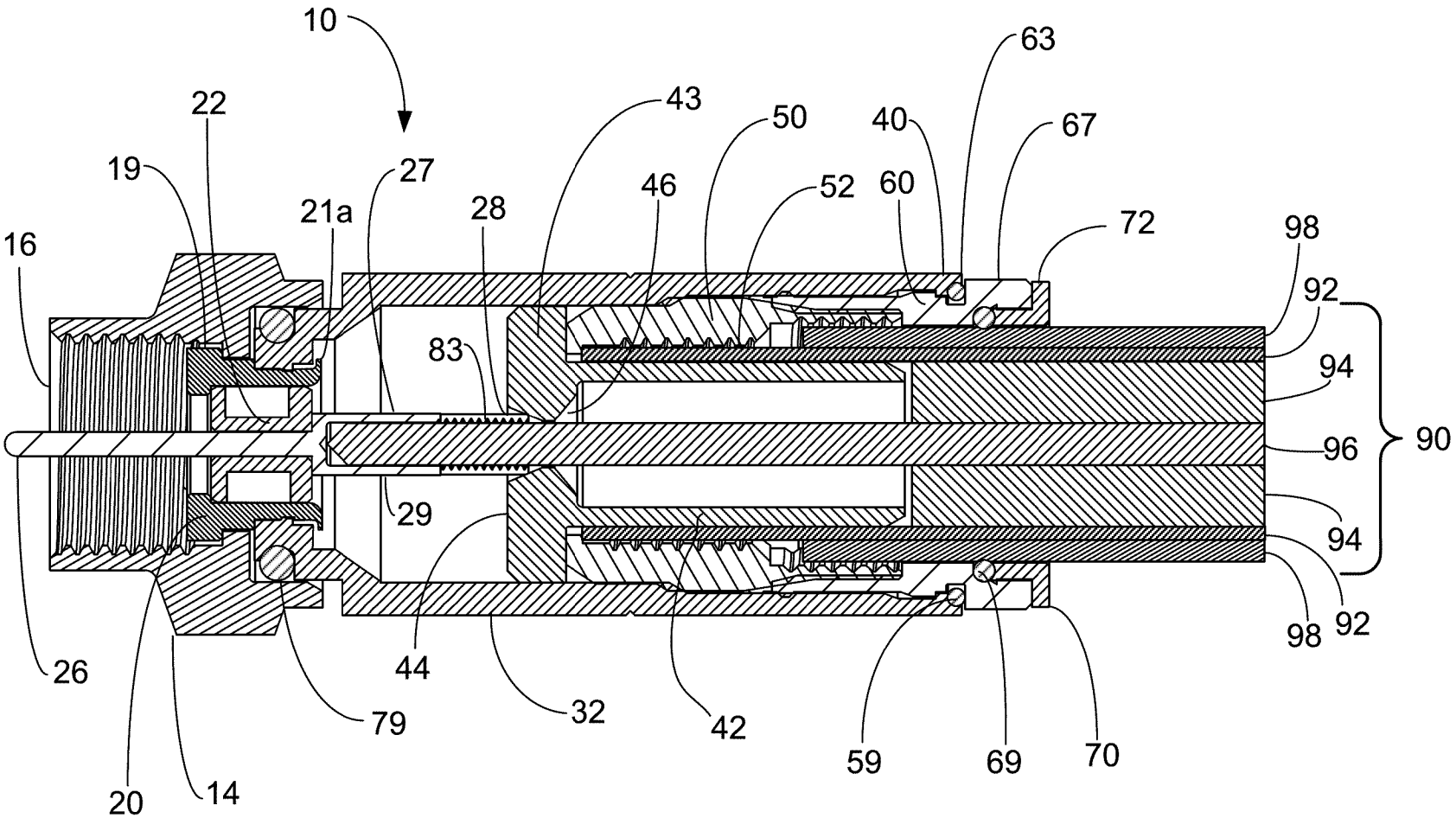
FIG. 6 is a sectional, side view of a connector in the closed position with a coaxial cable inserted in the connector according to an exemplary embodiment.

FIG. 6 shows a coaxial cable 90 secured in the connector 10 with the center conductor 96 inserted in the connector end 28 of the terminal pin 27 and the circumferential grooves 83 engaging the center conductor 96. The outer conductor 92 of the coaxial cable 90 electrically contacts the housing 32 through the metal ferrule 50 and thereby electrically connects the outer conductor 92 to the nut 14. The retaining ring 70 is pushed into the second end 64 of the plastic sleeve 60 to secure the plastic sleeve 60 in the latching mechanism 40 on the second end 33 of the housing 32. The plastic sleeve 60 also forces the second end 56 of the ferrule 50 against the jacket 98 of the coaxial cable 90 to mechanically secure the cable 90 in the connector 10.

Figure 7:
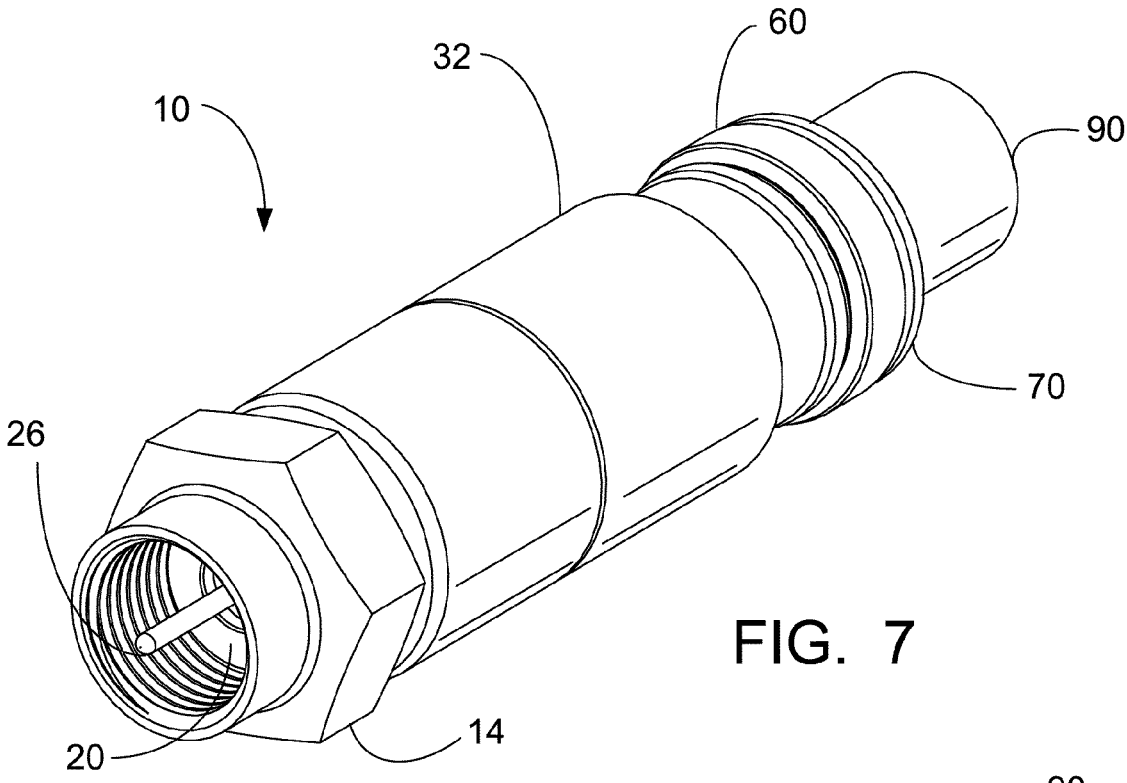
FIG. 7 is a perspective view of a connector in the open position with a coaxial cable inserted in the connector according to an exemplary embodiment.
Figure 8:
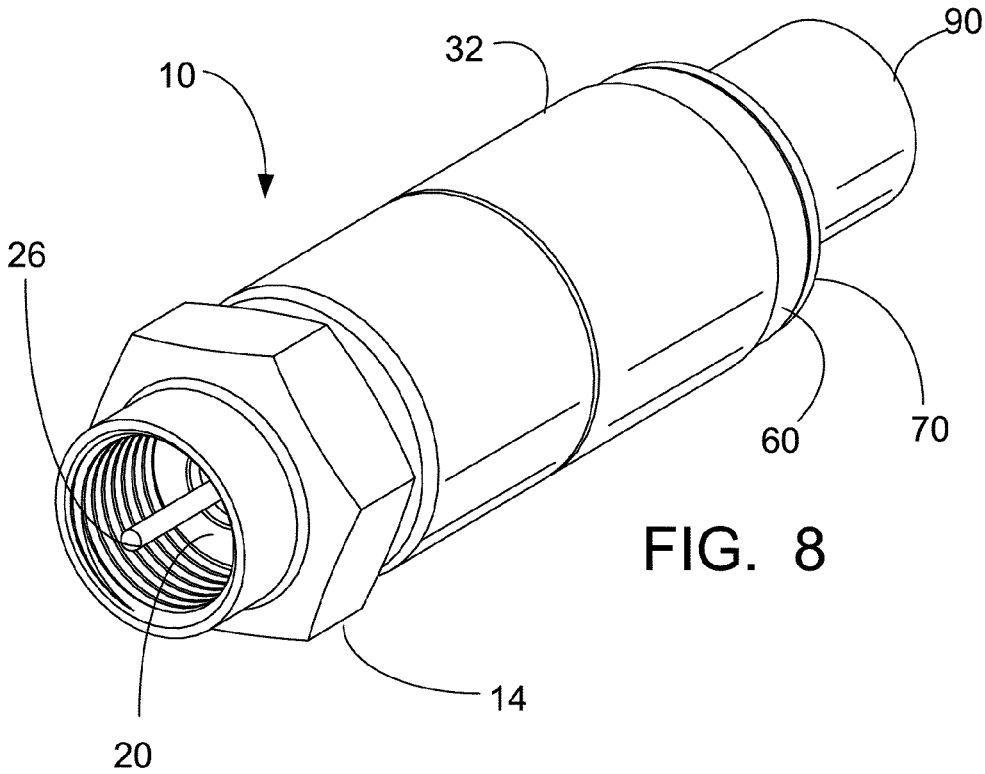
FIG. 8 is a perspective view of a connector in the closed position with a coaxial cable inserted in the connector according to an exemplary embodiment.

FIG. 7 shows the connector 10 in the open position with a coaxial cable 90 inserted in the connector 10. FIG. 8 shows the connector 10 in the closed position after the retaining ring 70 is pushed into the housing 32 to secure the plastic sleeve 60 and coaxial cable 90 in the housing 32.

Thus, while there have been described various embodiments of the present invention, those skilled in the art will realize that other embodiments can be made without departing from the spirit of the present disclosure, and it is intended to include all such further modifications and changes as come within the true scope of the claims set forth herein.

What is claimed is:

1. A connector for connecting a coaxial cable to a device, the coaxial cable having a center conductor, an outer conductor, a dielectric insulation material between the center and outer conductors and a cable jacket, wherein the connector comprises:

a nut having a first end, a second end and an axial bore between the first and second ends, wherein the first end has an internal thread and the second end has a recessed opening;

a terminal pin comprising a solid pin end, a connector end and a longitudinal axis, wherein the connector end has an aperture for receiving the center conductor of the coaxial cable;

an insulator having a first end, a second end, an axis between the first and second ends and an aperture extending along the axis, wherein the aperture receives the solid pin end of the terminal pin;

a half-spool retainer having a first end, a second end and a cylindrical body having an axial bore that extends between the first and second ends, wherein the first end has a rim extending radially outwardly from the body and the second end is flarable;

a housing comprising a cylindrical body having a first end, a second end and an axial bore between the first and second ends, wherein the first end has a collar and the second end has a latching mechanism;

a terminal post comprising a cylindrical body having a first end, a second end and an axial bore between the first and second ends, wherein the first end has a flange and the flange has an aperture;

a ferrule formed from an electrically conductive material having a first end, a second end, an outer surface, an inner surface, an outer surface and a slot extending between the first and second ends, wherein the first end of the ferrule slidably receives the second end of the terminal post;

a plastic sleeve having a first end and a second end, wherein the first end of the sleeve slidably receives the second end of the ferrule; and a retaining ring having a first end and a flanged second end, wherein the first end of the retaining ring is inserted into the second end of the plastic sleeve;

wherein the second end of the half-spool retainer passes through the first end of the nut and connects to the collar, wherein the insulator is inserted in the half-spool retainer and the solid pin end is inserted in the aperture in the insulator, wherein the terminal post, ferrule and plastic sleeve are inserted into the second end of the housing, and wherein the retaining ring is inserted into the second end of the plastic sleeve to secure the plastic sleeve in the latching mechanism.

2. The connector according to claim 1, wherein the second end of the half-spool retainer is flared after it is inserted in the collar.

3. The connector according to claim 1, wherein the connector end of the terminal pin comprises a cylindrically-shaped wall having one or more slots extending substantially parallel to the longitudinal axis of the terminal pin.

4. The connector according to claim 1, wherein the plastic sleeve compressively contacts the outer surface of the ferrule when the plastic sleeve is secured in the latching mechanism.

5. The connector according to claim 1, wherein the first end of the ferrule comprises a first section having a first inner diameter and the second end of the ferrule comprises a second section having a second inner diameter which is less than the first inner diameter, wherein the ferrule and the body of the terminal post form an annular space, and wherein the annular space between the first section and the body of the terminal post is sized to receive the outer conductor of a coaxial cable.

6. The connector according to claim 1, wherein the ferrule further comprises a first section adjacent to the first end and having a first inner diameter and a first outer diameter, a second section adjacent to the second end and having a second inner diameter and a second outer diameter, and a mid-section located between the first and second ends and having a third inner diameter and a third outer diameter, and wherein the first and third inner diameters are substantially equal and less than the second inner diameter and the third outer diameter is greater than the first and second outer diameters.

7. The connector according to claim 6, wherein the housing further comprises a first section adjacent to the first end and a second section adjacent to the second end, wherein the first section has a first interior surface and a first inner diameter and the second section has a second interior surface and a second inner diameter which is larger than the first inner diameter, and wherein, when the plastic sleeve is secured in the latching mechanism, the first interior surface of the housing compressively contacts the first end of the ferrule.

8. The connector according to claim 1, wherein the flange on the first end of the terminal post has a beveled surface around the aperture for receiving the connector end of the terminal pin.

9. The connector according to claim 8, wherein the body of the terminal post has an external surface with an outer diameter which is sized to receive the outer conductor of a coaxial cable and wherein the center conductor of the coaxial cable passes through the axial bore in the terminal post and into the aperture in the connector end of the terminal pin.

10. The connector according to claim 1, wherein the second end of the plastic sleeve comprises a rim and a circumferential groove.

11. The connector according to claim 10, wherein the groove engages the latching mechanism on the second end of the housing when the plastic sleeve is secured in the latching mechanism.

12. The connector according to claim 1, wherein the first end of the nut has an internally threaded hub extending therefrom.

13. A connector for connecting a coaxial cable to a device, the coaxial cable having a center conductor, an outer conductor, a dielectric insulation material between the center and outer conductors and a cable jacket, wherein the connector comprises:

a nut having a first end, a second end and an axial bore between the first and second ends, wherein the first end has an internal thread and the second end has a recessed opening;

a terminal pin comprising a solid pin end, a connector end and a longitudinal axis, wherein the connector end has an aperture for receiving the center conductor of the coaxial cable;

a spool-shaped insulator having a first end, a second end, an axis between the first and second ends and an aperture extending along the axis, wherein the aperture receives the solid pin end of the terminal pin;

a half-spool retainer having a first end, a second end and a cylindrical body having an axial bore that extends between the first and second ends, wherein the first end has a rim extending radially outwardly from the body and the second end is flarable;

a housing comprising a cylindrical body having a first end, a second end, an axial bore between the first and second ends, a first section adjacent to the first end and a second section adjacent to the second end, wherein the first section has a first interior surface and a first inner diameter and the second section has a second interior surface and a second inner diameter which is larger than the first inner diameter, and wherein the first end has a collar and the second end has a latching mechanism;

a terminal post comprising a cylindrical body having a first end, a second end and an axial bore between the first and second ends, wherein the first end has a flange and the flange has an aperture;

a ferrule formed from an electrically conductive material and comprising a first end, a second end, an outer surface, an inner surface, a slot extending between the first and second ends, a first section adjacent to the first end and having a first inner diameter and a first outer diameter, a second section adjacent to the second end and having a second inner diameter and a second outer diameter, and a mid-section located between the first and second ends and having a third inner diameter and a third outer diameter, and wherein the first and third inner diameters are substantially equal and less than the second inner diameter and the third outer diameter is greater than the first and second outer diameters, wherein the first end of the ferrule slidably receives the second end of the terminal post;

a plastic sleeve having an outer surface, a first end, a second end and a circumferential groove on the outer surface, wherein the first end of the sleeve slidably receives the second end of the ferrule; and a retaining ring having a first end and a flanged second end, wherein the first end of the retaining ring is inserted into the second end of the plastic sleeve;

wherein the second end of the half-spool retainer passes through the first end of the nut and connects to the collar, wherein the insulator is inserted in the half-spool retainer and the solid pin end is inserted in the aperture in the insulator, wherein the terminal post, ferrule and plastic sleeve slide into the housing, and wherein the second end of the plastic sleeve is inserted into the housing and the retaining ring is inserted into the second end of the plastic sleeve to secure the plastic sleeve in the latching mechanism.

14. The connector according to claim 13, wherein the second end of the half-spool retainer is flared after it is inserted in the collar.

15. The connector according to claim 13, wherein, when the plastic sleeve is secured in the latching mechanism, the first interior surface of the housing compressively contacts the first section of the ferrule.

16. The connector according to claim 13, wherein the connector end of the terminal pin comprises a cylindrically-shaped wall having one or more slots extending substantially parallel to the longitudinal axis of the terminal pin.

17. A connector for connecting a coaxial cable to a device, the coaxial cable having a center conductor, an outer conductor, a dielectric insulation material between the center and outer conductors and a cable jacket, wherein the connector comprises:

a nut having a first end, a second end and an axial bore between the first and second ends, wherein the first end has an internally threaded hub extending therefrom and the second end has a recessed opening;

a terminal pin comprising a solid pin end, a connector end and a longitudinal axis, wherein the connector end has an aperture for receiving the center conductor of the coaxial cable;

a spool-shaped insulator having a first end, a second end, an axis between the first and second ends and an aperture extending along the axis, wherein the aperture receives the solid pin end of the terminal pin;

a half-spool retainer having a first end, a second end and a cylindrical body having an axial bore that extends between the first and second ends, wherein the first end has a rim extending radially outwardly from the body and the second end is flarable;

a housing comprising a cylindrical body having a first end, a second end, an axial bore between the first and second ends, a first section adjacent to the first end and a second section adjacent to the second end, wherein the first section has a first interior surface and a first inner diameter and the second section has a second interior surface and a second inner diameter which is larger than the first inner diameter, and wherein the first end has a collar and a latching mechanism extends inwardly from the second interior surface;

a terminal post comprising a cylindrical body having a first end, a second end and an axial bore between the first and second ends, wherein the first end has a flange and the flange has an aperture;

a ferrule formed from an electrically conductive material having a first end, a second end, an outer surface, an inner surface and a slot extending between the first and second ends, a first section adjacent to the first end and having a first inner diameter and a first outer diameter, a second section adjacent to the second end and having a second inner diameter and a second outer diameter, and a mid-section located between the first and second ends and having a third inner diameter and a third outer diameter, and wherein the first and third inner diameters are substantially equal and less than the second inner diameter and the third outer diameter is greater than the first and second outer diameters, wherein the first end of the ferrule slidably receives the second end of the terminal post;

a plastic sleeve having an outer surface, a first end, a second end and a circumferential groove on the outer surface, wherein the first end of the sleeve slidably receives the second end of the ferrule; and a retaining ring having a first end and a flanged second end, wherein the first end of the retaining ring is inserted into the second end of the plastic sleeve;

wherein the second end of the half-spool retainer passes through the first end of the nut and connects to the collar, wherein the insulator is inserted in the half-spool retainer and the solid pin end is inserted in the aperture in the insulator, wherein the terminal post, ferrule and plastic sleeve slide into the housing, wherein the body of the terminal post has an external surface which receives the outer conductor of the coaxial cable, wherein the connector end of the terminal pin receives the center conductor of the coaxial cable, wherein the retaining ring is inserted into the plastic sleeve and, when a force is applied to the retaining ring, the connector end of the terminal pin compresses onto the center conductor, the first section of the ferrule is compressed between the inner surface of the housing and the terminal post, the first end of the plastic sleeve compresses against the second section of the ferrule and the circumferential groove in the plastic sleeve engages the latching mechanism.

18. The connector according to claim 17, wherein the second end of the half-spool retainer is flared after it is inserted in the collar.

19. The connector according to claim 17, wherein the connector end of the terminal pin comprises a cylindrically-shaped wall having one or more slots extending substantially parallel to the longitudinal axis of the terminal pin.

20. The connector according to claim 17, wherein the first end of the nut has an internally threaded hub extending therefrom.

* * * * *